United States Patent [19]

Mühlratzer et al.

[11] Patent Number: 4,475,958

[45] Date of Patent: Oct. 9, 1984

[54] METHOD FOR THE MANUFACTURE OF DEFORMATION RESISTANT OXIDIC PROTECTIVE LAYERS

[75] Inventors: August Mühlratzer, Gilching; Bruno Stemmler, Karlsfeld; Hans Zeilinger, Puchhein-Bahnhof, all of Fed. Rep. of Germany

[73] Assignee: M.A.N. Maschinenfabrik Augsburg-Nurnberg Aktiengesellchaft, Fed. Rep. of Germany

[21] Appl. No.: 440,173

[22] Filed: Nov. 8, 1982

[30] Foreign Application Priority Data

Nov. 13, 1981 [DE] Fed. Rep. of Germany ..... 3145236

[51] Int. Cl.[3] ..... C23C 11/08

[52] U.S. Cl. ..... 148/6.35; 148/6.3

[58] Field of Search ..... 148/6.3, 6.31, 6.35; 427/343

[56] References Cited

U.S. PATENT DOCUMENTS

| | | | |
|---|---|---|---|
| 2,187,589 | 1/1940 | Lenel | 148/6.35 |
| 2,943,031 | 6/1960 | Wainer | 148/6.3 X |
| 3,345,218 | 10/1967 | Brookover et al. | 148/6.3 X |
| 3,634,147 | 1/1972 | Helwig et al. | 148/6.3 X |

*Primary Examiner*—Evan K. Lawrence

*Attorney, Agent, or Firm*—Scully, Scott, Murphy & Presser

[57] ABSTRACT

Method for the manufacturing of deformation-resistant oxide coatings on metallic workpieces, in which fissures are induced in the oxide layer formed on the surface of the workpiece as a result of severe deformations in the base material. The fissures are subsequently healed by filling the interstices with subsequently produced oxide resulting from a post-oxidation process. Repeating the process several times controls the natural stress condition of the surface layer such that the effective elastic deformation range is extended.

6 Claims, No Drawings

METHOD FOR THE MANUFACTURE OF DEFORMATION RESISTANT OXIDIC PROTECTIVE LAYERS

BACKGROUND OF THE INVENTION

1. Field of the Invention

The present invention relates to a method for the manufacturing of deformation-resistant oxidic protective layers on workpieces.

In an oxidizing atmosphere, many metallic materials will form oxide coatings on their surfaces which can provide a significant protective action against oxidation and corrosion. Moreover, this effect as thermal, diffusion or permeation barrier layers is of important significance.

2. Discussion of the Prior Art

Current samples for the formation of extremely dense, well-covering layers are aluminum, as well as austenitic steels, whose outstanding resistance to corrosion is predicated on such mechanisms.

However, as a rule, oxidic coating layers are brittle so as not to be able to safely sustain appreciable plastic deformations. On the other hand, depending upon the structural make-up and thickness of the layer, they have the capacity to absorb significant elastic stresses. Due to the strong bond, the theoretical tear resistance of the layers is high, and the load capacity of a layer more closely approaches this value the greater the absence of voids. Consequently, mechanically or thermally induced plastic deformations of the base material can be safely sustained without fissures by the layer only to the extent that, taking into consideration the modulus of elasticity of the layer, they correspond to a linearly-elastic stress which is below the practical tear strength. Total deformations which exceed the limit will commence the formation of fissures in the layer.

SUMMARY OF THE INVENTION

Accordingly, it is a primary object of the present invention to provide a method for the manufacturing of protective oxidic layers which can be safely subjected to high deformations and temperature changes without causing the development of fissures in the protective layer.

It is a more specific object of the present invention to initially produce an oxide layer on the surface of a metallic workpiece which is subsequently subjected to a fissure formation process, and thereafter there is carried out, subsequent to an intermediate heat treatment, a post-oxidation process by means of which there is healed the fissures.

In accordance with this method, the newly-formed oxide produced during the post-oxidation process will fill the interstices or fissures, and places the originally formed portions of the layer, which are separated by the fissure, under compressive stress. Achieved hereby is that the utilizable elastic deformation range of the protective layer is considerably extended, thereby allowing the layer to sustain a higher degree of total deformation without causing fissures.

Through intermediary of the method of the present invention the brittleness inherent in the oxidic coatings can be suffused and thereby such protective layer systems can be rendered technically usable.

Furthermore, the method of the present invention is generally applicable in connection with any method of oxidation.

Under these conditions there are produced extremely dense layers so that, in conjunction with the fissure formation and post-oxidation processes, there is obtained a high-grade layer which not only affords a high thermal and mechanical resistance, but also provides an excellent degree of protection against diffusion and permeation.

The fissure formation can be preferably produced through rapid temperature changes, such as would occur during start-up or shut-down procedures in the components of thermal installations. During the shut-down sequences there are produced a large number of fissures with a characteristic spacing which depends upon the shear stresses induced in the layer through the interface between the coating layer base material (depending on the adhesive bond), and also depending upon the tear strength of the layer and the stress-strain relationships of the mutually contacting components of the composite member.

The fissures in the oxidic coating can also be mechanically induced through variations in pressure.

Pursuant to a further aspect of the present invention the fissure formation phase is followed by an intermediate heat treatment in a nonoxidizing atmosphere.

In this manner there can be again compensated for the depletion of alloying components which has occurred below the oxide layer which has oxidized, or preferentially has become oxidized.

This then provides the advantage that the same oxide is formed during the subsequent oxidation step with the same matrix parameters and the same growth configurations as that of the original oxide layer. This will avoid that with separate oxidation steps there will even be increased the susceptibility to fissuring, as would be the case with an inhomogeneous oxide layer.

For alloys which form chromium or aluminum oxide, it is preferred to employ a hydrogen atmosphere for the intermediate heat treatment.

The utilization of a hydrogen atmosphere in the presence of layer of difficult to reduce oxides, such as $Cr_2O_3$ or $Al_2O_3$, affords the advantage in that the more easily reducible oxides which are always formed to some extent during the oxidation of technical alloys, as for instance iron oxides and NiO, can be largely excluded.

In a further aspect of the present invention, the fissure forming process and the post-oxidation process are alternately repeated at least once. This serves to reduce the spacing between fissures and accordingly, improves the elasticity of the overall layer.

EXAMPLE

Heat exchanger pipe coils produced from the material X 10 NiCrAlTi 32 20 (DIN material designation 1.4876) were treated as follows:

1. The pipe coils were exposed in a pre-oxidation process at 950° C. under normal pressure for about 4 hours to an argon atmosphere containing about 20 mbar water vapor. Produced thereby was a 2 μm to 3 μm thick oxide layer, which essentially consisted of chromium oxide.

2. The pipe coils were then cooled down to 100° to 200° C., and thereafter rapidly heated to about 950° C., whereby there concurrently occurred a fissure formation. Hydrogen was concurrently admixed to the argon until substitution was complete.

3. After about 2 hours, 20 mbar water vapor was again added to the atmosphere and thereby there was carried out a post-oxidation phase for 4 hours under the same conditions as employed during pre-oxidation. During this process the hydrogen was again partially or fully replaced with argon.

4. The process steps 2 and 3 were then repeated one time. This produced a gastight oxide layer which was resistant to temperature changes. The spacing between fissures was in the μm range.

Further repetitions of process steps 2 and 3 will still improve the tear strength of the oxide layer as a result of further reductions in the spacings between fissures.

What is claimed is:

1. Method for the manufacture of deformation-resistant oxidic protective layers on metallic workpieces; comprising (a) forming an oxide layer on the surface of the workpiece; (b) subjecting the oxide layer to a fissure forming process; (c) effecting a heat treatment of the workpiece in a non-oxidizing atmosphere; and (d) finally, effecting a post-oxidation process for healing the fissures through oxide formation therein.

2. Method as claimed in claim 1, comprising effecting the oxidation steps through the application of water vapor.

3. Method as claimed in claim 1, comprising causing the formation of fissures in the oxidic protective layer through rapid changes in temperature.

4. Method as claimed in claim 1, comprising causing the formation of fissures in the oxidic protective layer through changes in pressure.

5. Method as claimed in claim 1, wherein the metallic workpiece is a metal alloy forming chromium or aluminum oxide, and the non-oxidizing atmosphere is a hydrogen atmosphere.

6. Method as claimed in claim 1, comprising repeating at least one time the fissure forming and subsequent post-oxidation steps after the first post-oxidation process.

* * * * *